US005417894A

United States Patent [19]

Witte, Sr.

[11] Patent Number: 5,417,894

[45] Date of Patent: May 23, 1995

[54] ADJUSTABLE SEAL ASSEMBLY FOR MODULATOR BLADES IN INDUSTRIAL HUMIDIFIERS

[75] Inventor: Billy R. Witte, Sr., Midlothian, Tex.

[73] Assignee: Air & Refrigeration Corp., Dallas, Tex.

[21] Appl. No.: 216,882

[22] Filed: Mar. 23, 1994

[51] Int. Cl.[6] ..... B01F 3/04

[52] U.S. Cl. ..... 261/23.1; 261/63; 55/224; 55/226

[58] Field of Search ..... 261/23.1, 63; 55/224, 55/226

[56] References Cited

U.S. PATENT DOCUMENTS

| | | | |
|---|---|---|---|
| 3,267,648 | 8/1966 | Allcorn, Jr. | 261/23.1 |
| 3,334,471 | 8/1967 | Herron | 261/63 |
| 3,596,439 | 8/1971 | Moragne | 261/96 |
| 4,260,563 | 4/1981 | Brulhet | 55/226 |
| 4,494,596 | 1/1985 | Bradshaw | 55/226 |
| 4,940,475 | 7/1990 | Yaeger | 55/224 |
| 5,019,300 | 5/1991 | Davis et al. | 261/23.1 |

*Primary Examiner*—Tim Miles

*Attorney, Agent, or Firm*—Richards, Medlock & Andrews

[57] ABSTRACT

An adjustable seal assembly is provided for better sealing along the length of modulator blades used in industrial humidifiers. The assembly comprises a channel that runs parallel with the blades. A seal is attached along the length of the channel and positioned for contact with a blade in the closed position. A threaded rod has one end attached to a midpoint along the channel and the other end threaded through a part of the frame of the bypass section such that rotating the threaded rod bows the channel so that the seal attached to the channel can be bowed to match any bow that may be in the blade.

5 Claims, 2 Drawing Sheets

ADJUSTABLE SEAL ASSEMBLY FOR MODULATOR BLADES IN INDUSTRIAL HUMIDIFIERS

TECHNICAL FIELD OF THE INVENTION

The present invention relates to a seal assembly that seals along the length of modulator blades of the type used in industrial humidifiers when the blades are in the closed position, and more particularly to such seals that can be adjusted to properly seal despite bowing of the modulator blades.

BACKGROUND OF THE INVENTION

The present invention is an improvement to industrial humidifiers of the type disclosed in U.S. Pat. No. 4,940,475 to Yaeger. With reference to the Yaeger patent, and in particular FIGS. 2 and 3, it can be seen that the humidifier has blades 70 in a bypass damper. Blades 70 are rotated to vary the degree that air can be bypassed. When it is desired that no air is bypassed, the blades are rotated to close the bypass and prevent air flow. As can be appreciated, a seal along the length of the blades is desirable to insure that when the blades are in the closed position no air is able to pass around the closed blades.

However, it has been found that on larger humidifier units where the length of the blades can approach 9 feet in length, it is difficult to obtain a uniformly tight seal over the full length of the blades because the torque of the actuator which turns the blades and the air pressure tend to cause the blades to bow at the middle. This bowing prevents a tight seal which allows some air to bypass the humidifier thereby lowering the system's ability to add humidity to the air stream.

Therefore a need exists for an adjustable seal for the blades that can be adjusted to tightly seal along the length of the blades despite bowing of the blades.

SUMMARY OF THE INVENTION

The present invention provides an adjustable seal assembly for modulator blades of industrial humidifiers that allows the seal to be adjusted to optimize the sealing along the entire length of the blades. The seal of the present invention overcomes variations in manufacturing tolerances and deflection caused by system pressure and actuator movement.

The assembly comprises a channel that runs parallel with the blades. A seal is attached along the length of the channel and positioned for contact with a blade in the closed position. A threaded rod has one end attached to a midpoint along the channel and the other end threaded through a part of the frame of the bypass section such that rotating the threaded rod bows the channel so that the seal attached to the channel can be bowed to match any bow that may be in the blade.

BRIEF DESCRIPTION OF THE DRAWINGS

For a more complete understanding of the present invention, and for further details and advantages thereof, reference is now made to the following description taken in conjunction with the accompanying drawings, in which.

DETAILED DESCRIPTION OF THE PREFERRED EMBODIMENT

As part of the disclosure of the present invention, the entire content of U.S. Pat. No. 4,940,475 to Yaeger is incorporated herein by reference. The Yaeger patent discloses the structure of an overall humidifier in which the seals of the present invention can be used.

Figure 1:
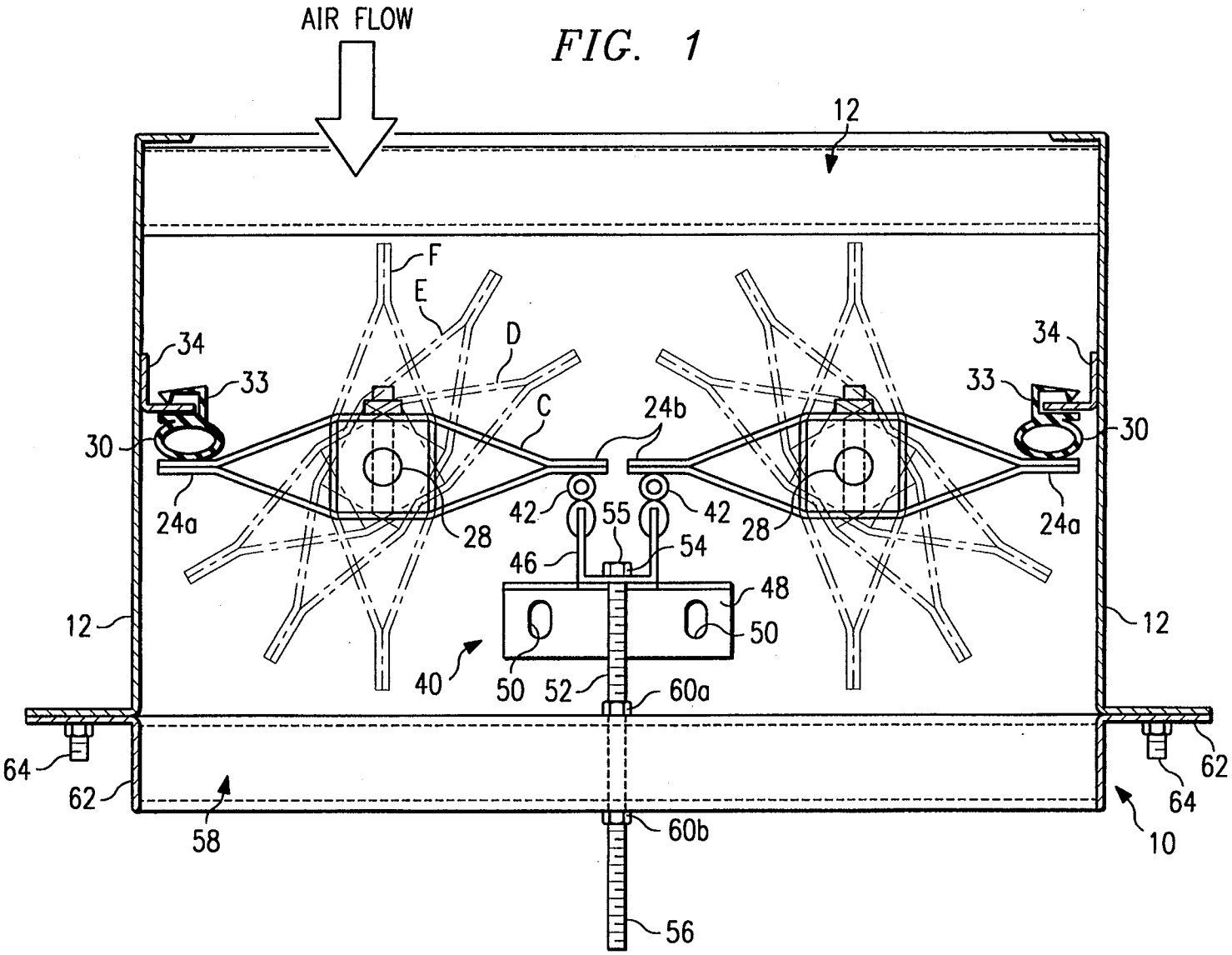
FIG. 1 is a top view of the adjustable seals of the present invention in a humidifier bypass section.
Figure 3:
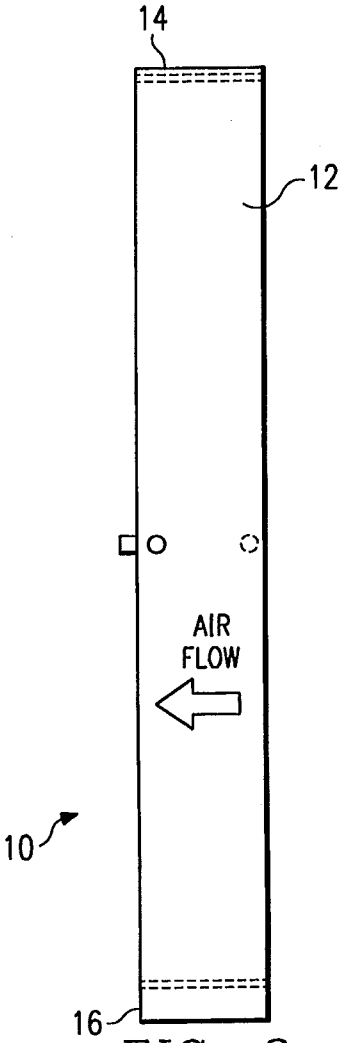
FIG. 3 is a side view of the humidifier bypass section in FIG. 1.
Figure 2:
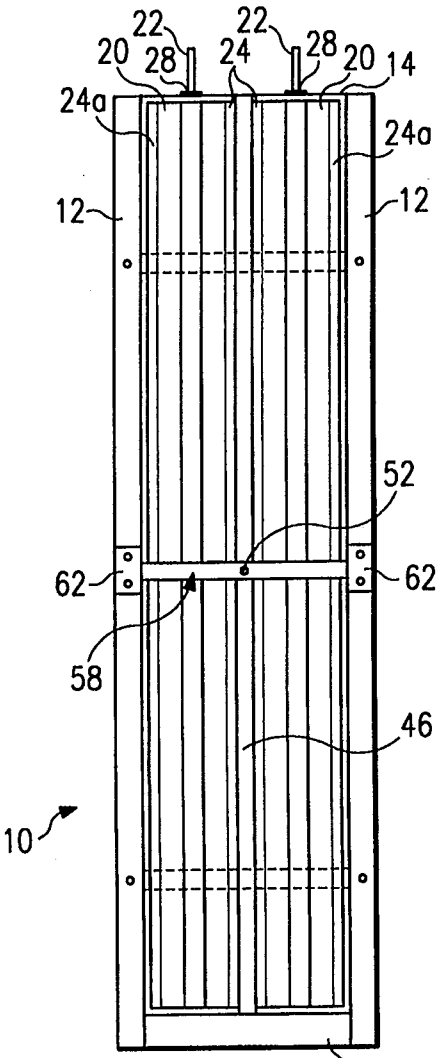
FIG. 2 is a front view of the humidifier bypass section shown in FIG. 1.

FIG. 1 is a top view of bypass section 10 which corresponds to "bypass gaps 54" in the Figures of the Yaeger patent. With additional reference to FIGS. 2 and 3, bypass section comprises sides 12, top 14 and bottom 16 which are frame pieces fabricated, fitted together and then welded as is commonly known. As can be envisioned, fabrication of bypass section 10 will result in variations between each fabricated section, and these variations will effect the sealing along the length of blades 20.

Figure 4:
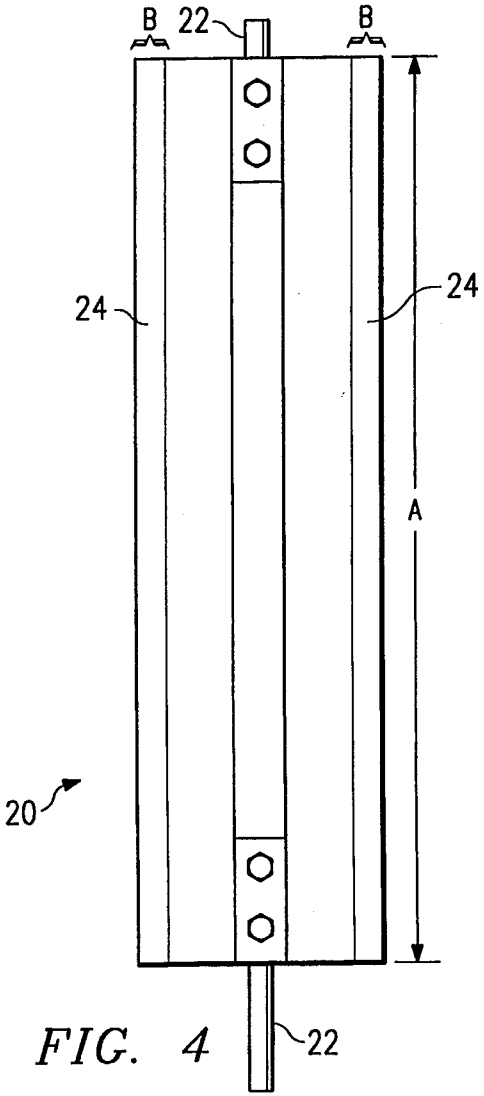
FIG. 4 is a front view of a modulator blade as used in the humidifier bypass section in FIG. 1.

FIG. 4 illustrates an exemplary blade 20 with pivot rods 22 extending from the top and bottom of blade 20. Blade 20 has length A and flat edges 24. Flat edges 24 each have width B.

With reference to FIG. 1, blades 20 are mounted in bypass section 10. Particularly, pivot rods 22 are mounted in bearings not shown and through holes 28. As so mounted, blades 20 can be rotated about their longitudinal axes which correspond to the pivot rods 22. Specifically, FIG. 1 shows blades 20 in the closed position C and in phantom blades 20 are shown in partially open position D, more open position E, and full open position F.

When blades 20 are in the closed position, outer flat edges **24*a* contact outer seals 30 which run the length of blades 20. Outer seals 30 are of a tubular elastomeric material that is attached by brackets 33 to the inside of bypass section 10 along angle 34. The tubular nature of outer seals 30 allows for a range of sealing against flat edges 24*a*. For example if flat edges 24*a* have a slight bow at some point along their length, the outer seals 30 can be compressed to absorb a bow in the direction of the seal. The force of the actuator which turns the blades can also be such that flat edges 24*a* can be biased against seals 30**.

The present invention resides in adjustable seal assembly 40. Inside flat edges **24*b* contact seals 42 which are mounted along legs 44 of channel 46. Channel 46 has at its top and bottom attachment brackets 48 which have slotted holes 50 for adjustable attachment to top 14 and bottom 16 of bypass section 10, respectively. Thus, an initial factor of adjustability is found in the slotted holes of brackets 48 for the initial alignment of blades 20 taking into account any variations in fabrication of bypass section 10**.

More importantly, though, is that channel 46 is adjustable at its middle by means of threaded adjustment rod 52 which has first end 54 retained at channel 46 by nut 55. Adjustment rod 52 has second end 56 which extends through adjustment support 58. Adjustment rod 52 is held by nuts **60*a* and *b* to adjustment support 58. To bow channel 46 in or out, nuts 60*a* and *b* are rotated accordingly to translate adjustment rod 52 which in turns bows channel 46 in or out. Preferably, adjustment rod 52 is attached to channel 46 near the middle of channel 46, however, adjustability can be achieved as long as the adjustment rod is attached anywhere along the length of channel 46 where the channel can still be bowed. Adjustment support 58 is fixed to bypass section 10 by brackets 62 which are bolted to bypass section 10 with bolts 64**.

Thus, if blades 20 become bowed for some reason such that a gap is created between flat edges 24 and seals 42, seals 42 can be bowed to mirror the bow of blades 20 by bowing channel 46 with adjustment rod 52. By matching seals 42 to any bow in blades 20, the efficiency of the humidifier can be increased significantly. Otherwise, unhumidified air can travel through the bow and mix with humidified air when it is not desired. When a mix of bypass air and humidified air is desired, the modulator blades are rotated to an open position to allow a desired amount of bypass air through the bypass section. But, when there needs to be a cessation of bypass air flow, the adjustable seal assembly of the present invention allows better matched sealing along the length of the blades despite any bows present in the blades.

Although the present invention has been described with respect to a preferred embodiment, various changes, substitutions and modifications of this invention may be suggested to one skilled in the art, and it is intended that the present invention encompass such changes, substitutions and modifications as fall within the scope of the appended claims.

I claim:

1. In a bypass section of an industrial humidifier that has pivoting modulator blades, an adjustable blade sealing assembly comprising:

a channel extending parallel with the blades and mounted to the bypass section;

a seal attached along the length of the channel, the seal positioned for contacting one of the blades along its length when the blade is in a closed position; and a threaded rod having a first end connected to a midpoint along the channel and a second end adjustably mounted through the bypass section such that rotating the rod varies the position of the rod with respect to the bypass section and bows the channel.

2. The assembly of claim 1 wherein the channel has a generally U-shaped cross-section such that two legs of the channel are defined as extending toward the blades and wherein the seal is attached along one of the legs of the channel.

3. The assembly of claim 2 further comprising a second seal attached along the other leg of the channel and positioned such that it can contact another blade along its length in the closed position.

4. The assembly of claim 1 wherein the channel has a bottom end adjustably attached to the bottom of the bypass section and a top end adjustably attached to the top of the bypass section.

5. The assembly of claim 1 wherein the second end of the threaded rod is threaded through a support that is attached to the bypass section.

* * * * *